United States Patent [19]

Wolcott

[11] 4,399,867

[45] Aug. 23, 1983

[54] METHOD FOR INJECTING A GASEOUS STREAM INTO A HOT SUBTERRANEAN ZONE

[75] Inventor: Herbert B. Wolcott, Plano, Tex.

[73] Assignee: Atlantic Richfield Company, Los Angeles, Calif.

[21] Appl. No.: 263,625

[22] Filed: May 14, 1981

[51] Int. Cl.³ ..... E21B 36/00; E21B 43/24

[52] U.S. Cl. ..... 166/261; 166/242; 166/302; 166/303

[58] Field of Search ..... 166/57, 59, 242, 256, 166/261, 268, 272, 302, 303, DIG. 1; 60/641.2, 641.3

[56] References Cited

U.S. PATENT DOCUMENTS

| | | | |
|---|---|---|---|
| 1,804,078 | 5/1931 | Baden | 166/242 X |
| 2,148,717 | 2/1939 | Whitney | 166/272 |
| 3,130,264 | 2/1964 | Barron | 166/303 X |
| 3,142,336 | 7/1964 | Doscher | 166/57 X |
| 3,221,813 | 12/1965 | Closmann et al. | 166/272 X |
| 3,358,756 | 12/1967 | Vogel | 166/272 X |
| 3,372,754 | 3/1968 | McDonald | 166/59 |
| 3,760,876 | 9/1973 | Blount et al. | 166/57 |
| 3,820,605 | 6/1974 | Barber et al. | 166/57 X |
| 3,878,312 | 4/1975 | Bergh et al. | 166/242 X |
| 4,147,213 | 4/1979 | Hollingsworth | 166/242 X |

FOREIGN PATENT DOCUMENTS

| | | | |
|---|---|---|---|
| 783427 | 4/1968 | Canada | 166/272 |

*Primary Examiner*—James A. Leppink
*Assistant Examiner*—George A. Suchfield
*Attorney, Agent, or Firm*—F. Lindsey Scott

[57] ABSTRACT

A method for injecting a gaseous stream into a hot subterranean zone by positioning a casing in fluid communication with the hot subterranean zone and the surface, insulating a lower portion of the outer surface of the casing and injecting the gaseous stream into the hot subterranean zone through the casing at a rate sufficient to maintain the casing below a selected maximum temperature. An apparatus useful in the practice of the method is also disclosed.

6 Claims, 4 Drawing Figures

METHOD FOR INJECTING A GASEOUS STREAM INTO A HOT SUBTERRANEAN ZONE

This invention relates to a method for injecting a gaseous stream into a hot subterranean zone.

This invention further relates to an apparatus for injecting a gaseous stream into a hot subterranean zone.

In a variety of processes for the recovery of heat and energy values from subterranean zones which may comprise coal deposits, petroleum deposits, shale oil deposits, or the like, a frequently occurring problem relates to the maintenance of a casing from the surface to the subterranean zone to inject gaseous streams into the subterranean zone. Such problems arise frequently in the in situ gasification of coal deposits. In such processes, problems arise because the temperatures in the in situ gasification zone may be in excess of 3,000° F. At such temperatures typical casing and tubing materials tend to melt, weaken or otherwise become unsuitable for the continued injection of gaseous or other streams into the subterranean zone. Further, the weakening of the casing may be a contributing factor to the ultimate collapse of the well structure into the subterranean zone with a resulting loss of ability to continue the injection of gas or other streams. Similar problems arise in the injection of gaseous streams into subterranean zones wherein shale oil deposits or petroleum deposits are being subjected to high temperature treatment for the recovery of heat values from the deposit. In such processes the gaseous stream injected in many instances contains steam or other constituents such as carbon dioxide or the like, in addition to a free oxygen-containing gas to support combustion. The design and operation of such wells has been a continuing problem and a continuing search is underway to develop improved methods for the installation and use of such wells.

In the preparation of the present patent application the following references were considered. U.S. Pat. Nos. 2,506,853; 3,216,499; 3,272,262; 3,338,286; and 3,372,754. These references are considered to be illustrative of the state of the art and are hereby incorporated in their entirety by reference.

It has now been found that gaseous streams may be readily and reliably injected into a hot subterranean zone by a method consisting essentially of (a) positioning a casing means in fluid communication with the hot subterranean zone and the surface; (b) insulating a lower portion of the outer surface of the casing, the lower portion including the portion of the casing in the hot subterranean zone; and (c) injecting the gaseous stream into the hot subterranean zone through the casing at a rate sufficient to maintain the casing below a selected maximum temperature. An apparatus comprising: (a) a casing fluidly communicating the hot subterranean zone and the surface; (b) insulation positioned on the outer surface of a lower portion of the casing, the lower portion including the portion of the casing in the hot zone; and (c) an injection means adapted to inject a gaseous stream into an upper end of the casing at a flow rate through said casing in excess of 5 lb./sec./ft$^2$ is useful in the practice of the method.

In the discussion of the Figures, the same numbers will be used throughout to refer to the same or similar components.

Figure 1:
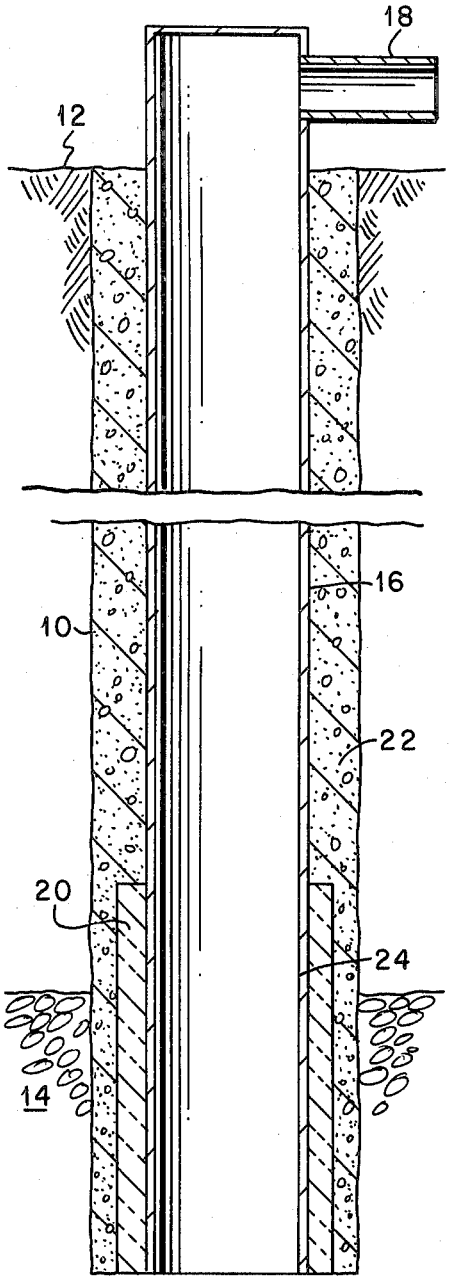
FIG. 1 is a schematic diagram of an embodiment of an apparatus useful in the practice of the method of the present invention.

In FIG. 1 a casing 16 is shown in position in a wellbore 10 so that it fluidly communicates the surface 12 and a subterranean zone 14. A gas inlet 18 is provided for the injection of gas into casing 16 for injection into subterranean zone 14. Casing 16 is normally cemented in place by cement 22 positioned about casing 16 to fill the annular space between the outer diameter of casing 16 and the inner diameter of wellbore 10. The use of cement to position casings in wellbores is well known to the art and will not be discussed further. A lower portion 24 of casing 16 includes insulation 20 positioned about its outer surface. Lower portion 24 normally comprises the portion of casing 16 exposed to formation 14 and extends for a suitable distance above formation 14 to avoid the exposure of uninsulated casing to elevated temperatures. In the installation of casing 16, wellbore 10 is typically drilled from surface 12 to the total depth to which casing 16 is to be set. Casing 16 is then positioned in wellbore 10 and cemented in place by the use of a cement shoe or the like. Insulation 20 is typically placed on the outer surface of casing 16 in the zones of interest prior to positioning casing 16 in wellbore 10 so that the insulation is in place as casing 16 is cemented in place.

In the practice of the method of the present invention utilizing the apparatus shown in FIG. 1, a gaseous mixture comprising steam, carbon dioxide, free oxygen and the like, is injected through gas inlet 18 into casing 16 and downwardly through casing 16 into formation 14. When the formation is a coal deposit the gaseous mixture is typically selected to gasify or partially combust the coal deposit with the gases typically being recovered from a nearby production well. Forward or reverse combustion can be used but in many instances it is found that very high temperatures exist either upon ignition or at some time during the life of the injection wells. The injected gaseous mixture may be varied widely depending upon the particular requirements of the process being conducted. Typically, free oxygen is provided by the injection of free oxygen, per se, oxygen enriched air, air or the like. Steam, carbon dioxide and the like may also be injected either as reactants or diluents. Typically, substantial quantities of steam are injected. By the method of the present invention, the problems associated with the high temperatures in zone 14 are overcome by injecting the gaseous mixture at a velocity such that the temperature of casing 16 is maintained below a selected maximum temperature by heat transfer to the injected gaseous stream. As a result, it is necessary that the gaseous stream be injected at a substantial velocity. Typically, injection rates of at least about 5 lb./sec./sq. ft. of cross-sectional area in casing 16 are required and desirably the injection rates are at least about 20 lb./sec./sq. ft. The use of the high injection rate results in improved heat transfer from the inner surfaces of casing 16 to the gaseous stream which is thereafter discharged into zone 14.

By the method of the present invention gaseous streams are readily injected through the apparatus shown to support combustion in the hot subterranean zone without the risk of casing collapse and the like.

Figure 2:
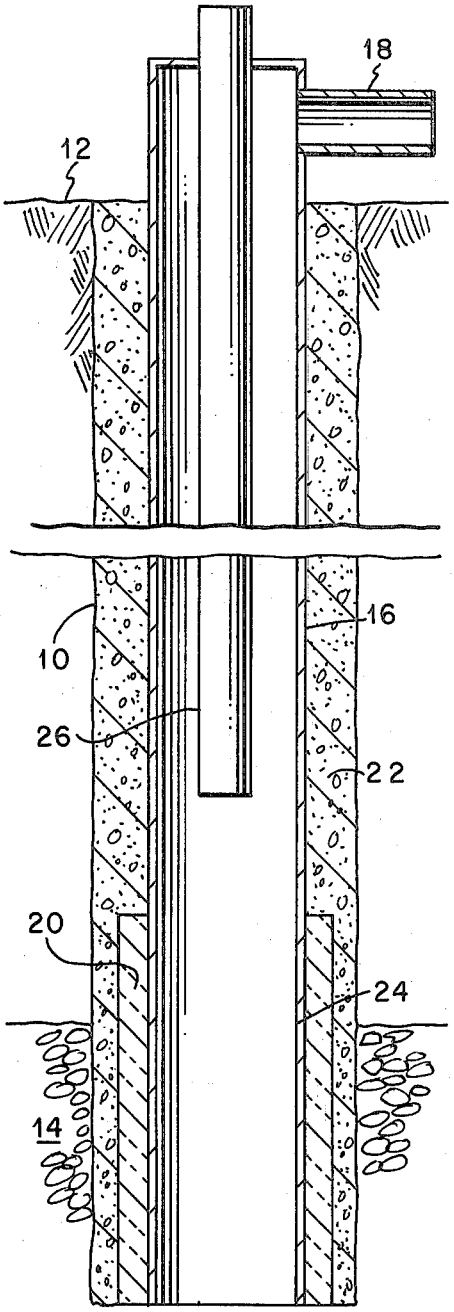
FIG. 2 is a schematic diagram of a further embodiment of the apparatus set forth in FIG. 1.

In the embodiment of the apparatus shown in FIG. 2 a tubing 26 is positioned in casing 16 for the injection of a second gaseous stream into casing 16. The operation of casing 16 and the associated apparatus is as described above with the exception that a second gaseous stream is injected through tubing 26.

Figure 3:
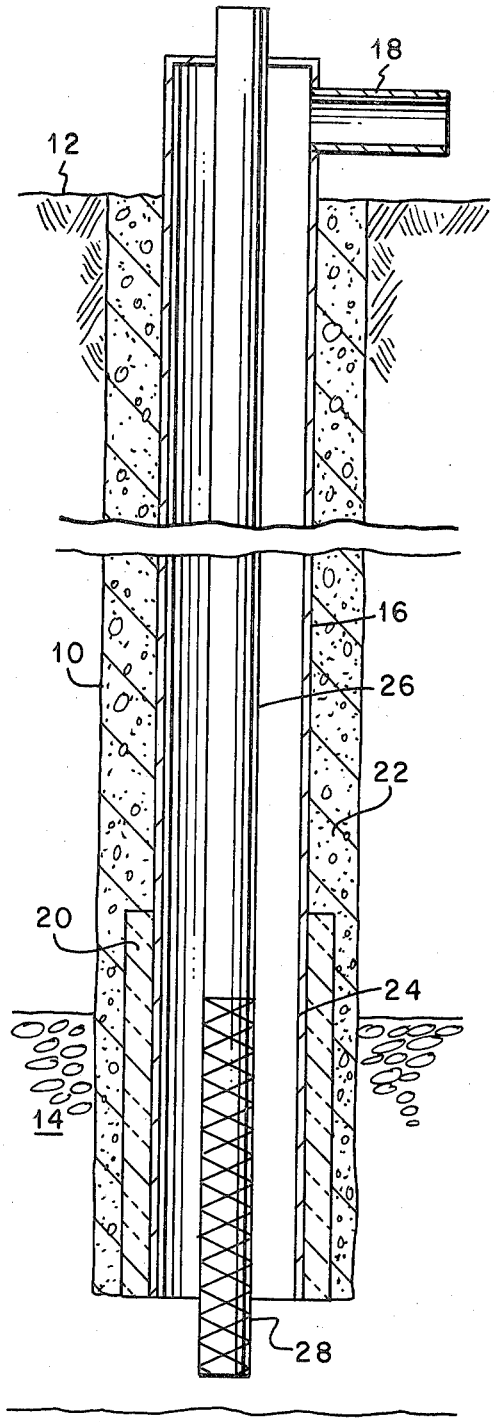
FIG. 3 is a schematic diagram of a further embodiment of the apparatus set forth in FIG. 1.

The embodiment of the apparatus shown in FIG. 3 is similar to that in FIG. 2 except that tubing 26 has been extended to the bottom of casing 16. Further, the lower portion of tubing 26 has been coated with a high-temperature coating 28, such as zirconium oxide, to extend the maximum operating temperature of tubing 26.

In the use of the apparatus described in FIGS. 2 and 3 in the practice of the method of the present invention a free oxygen-containing gas is injected through tubing 26 with steam, carbon dioxide, or a similar gas, being injected through casing 16. The steam, carbon dioxide, or the like, is injected at a rate as described above to maintain the temperature of casing 16 below a selected maximum. The injection of the free oxygen-containing gas through tubing 26 is at a flow rate which can be independent of the rate at which steam, carbon dioxide, or the like, is injected through casing 16. Since tubing 26 is inside casing 16 it is of course maintained below the selected maximum temperature for casing 16. While tubing 26 is shown as extending somewhat below the bottom of casing 16, such may not be the case in practice and in many instances it is quite likely that the end of tubing 26 below casing 16 will be burned off.

Figure 4:
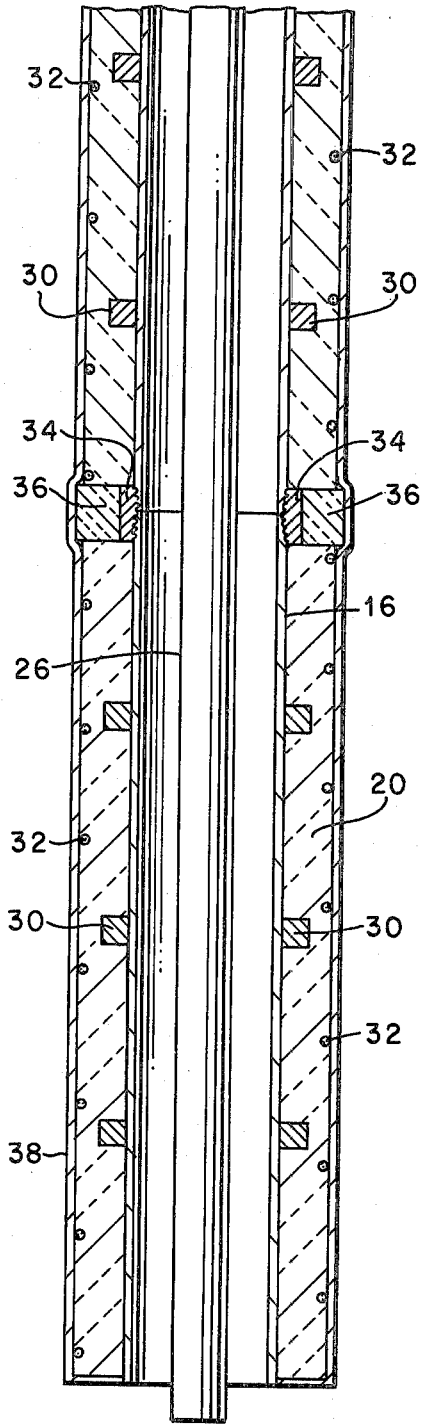
FIG. 4 is a schematic diagram of the installation of insulation on the lower portion of the casing shown in FIG. 1.

In FIG. 4 the installation of the insulation on the outer diameter of casing 16 is shown in somewhat greater detail. In a desired embodiment a series of projections 30 are positioned on the outer surface of casing 16 to help retain insulation 20 in position. Insulation 20 may be sprayed on or it may be positioned by wrapping or otherwise about the outer surface of casing 16. As shown in the Figure, a plurality of ropes 32 which are fabricated from the same material as the insulation are used to secure insulation 20 in place about casing 16. Similarly, sections 36 of insulation have been fitted to cover joints 34 in casing 16. The insulation is also desirably encased in a sheath 38 which may be of any suitable material. The sheathing 38 is desirably positioned about insulation 20 to maintain it in position on casing 16 during installation. Sheathing 38 is normally not of a highly durable material since its primary function is to protect the insulation during installation. Sheathing 38 will normally burn off in exposed areas upon encountering high temperatures.

Typically, casing 16 is installed in a formation prior to commencement of the process which results in the elevated temperatures in the subterranean formation, be it a shale oil, petroleum or coal deposit. While the method of the present invention and the apparatus of the present invention are useful in the practice of the recovery of heat values from substantially any subterranean carbonaceous formation, the use of the method and apparatus is considered to be particularly suitable for use in the in situ gasification of coal deposits. In the use of the method and apparatus in such applications, typically, the wellbore is drilled and the casing installed prior to the ignition of the coal deposit in the vicinity of the wellbore. Thereafter, the casing as described above is protected against high temperatures encountered in the gasification of the coal deposit. The casing is normally fabricated from conventionally-used casing materials and the insulation used is desirably selected from materials which have melting points in excess of 3500° F. Some such materials are aluminum oxide, refractory fibers and the like as known to those skilled in the art. Such materials have melting points in excess of 3500° F. and are conventionally used for insulation in applications up to about 2600° F.

The lower portion of tubing 26 may be coated with a refractory coating 28 such as zirconium oxide. Zirconium oxide is typically applied by plasma spraying or the like and has been used to protect metal parts in aircraft engines, etc., up to temperatures of about 2800° F. The use of zirconium oxide to protect tubing 26 is optional, although in some instances its use may be preferred.

The high gas flow rates are desirable to achieve the desired cooling of casing 16. Flow rates of at least 5 lb./sec./ft.$^2$ of cross-sectional area in casing 16 or in the annulus between the inner diameter of casing 16 and the outer diameter of tubing 26 are considered suitable. For greater cooling higher flow rates are required and it is preferred that flow rates greater than about 20 lb./sec./ft.$^2$ be used. Clearly the use of higher flow rates than necessary for the injection of desired quantities of materials or for adequate cooling is not necessary. The amount of material required in the formation is dependent upon numerous variables well known to those skilled in the art. Similarly, by the use of thermocouples and the like the temperature in casing 16 can be determined and the flow rates adjusted accordingly to maintain the casing temperature below a selected maximum. In most instances it is expected that flow rates greater than about 5 lb./sec./ft.$^2$ will be found suitable.

By the process of the present invention, the gaseous stream injected is injected at a relatively high velocity so that it effectively cools casing 16 as protected by insulation 20, thereby permitting the use of cased wells in temperature environments which are well in excess of the operating temperature of materials typically used for the fabrication of such casings. As a result, the use of the apparatus and method of the present invention permits the use of cased wells for the injection of free oxygen-containing gases into hot subterranean zones reliably and economically.

In a variation of the method and apparatus of the present invention, gases can be recovered from such hot subterranean zones. While such is not the preferred use, it is pointed out that those skilled in the art may consider such variations desirable.

It is pointed out that the embodiments of the invention set forth above are illustrative rather than limiting in nature and that many variations and modifications are possible within the scope of the present invention. Many such variations may be considered obvious and desirable based upon the foregoing description of preferred embodiments and the following examples.

EXAMPLES

The following examples are calculated results based upon the assumptions set forth to demonstrate the effectiveness of the method and apparatus discussed above. The calculations are based on:

| | |
|---|---|
| Oxygen - steam molal ratio | 1 |
| Steam temperature | 350° F. |

-continued

| | |
|---|---|
| Heat loss to formation | 45,000 B.T.U./hr. |

(based on a 10-foot diameter cavity and coal thermal conductivity of 0.2 B.T.U./Hr. ft. °F.)

The calculated solids temperature is about 2500° F. The calculations are based on the use of 4.5-inch outer diameter casing and 2⅜-inch outer diameter tubing. The apparatus shown in FIG. 3 is used in all the examples below. All temperatures are in °F.

EXAMPLE 1

When one inch of insulation is used with a steam injection rate of 469 lbs./hr. of steam, an oxygen injection rate of 835 lbs./hr. of oxygen and a 2000° F. process temperature the following maximum temperatures can be calculated:

TABLE I

| Length of Heated Zone (ft.) | Casing Wall Temp. | Steam Temp. | Tubing Wall Temp. | Oxygen Temp. |
|---|---|---|---|---|
| 0.0 | 529. | 350. | 350. | 350. |
| 10. | 598. | 428. | 380. | 358. |
| 20. | 655. | 491. | 415. | 379. |
| 30. | 703. | 545. | 451. | 408. |
| 40. | 745. | 592. | 489. | 441. |
| 50. | 783. | 635. | 526. | 476. |
| 60. | 818. | 674. | 564. | 512. |
| 70. | 851. | 712. | 601. | 549. |
| 80. | 883. | 747. | 537. | 586. |
| 90. | 913. | 781. | 673. | 622. |
| 100. | 943. | 814. | 707. | 658. |

EXAMPLE 2

When the conditions in Example 1 are varied by increasing the process temperature to 3500° F. the following maximum temperatures can be calculated:

TABLE II

| Length of Heated Zone (ft.) | Casing Wall Temp. | Steam Temp. | Tubing Wall Temp. | Oxygen Temp. |
|---|---|---|---|---|
| 0.0 | 967. | 350. | 350. | 350. |
| 10. | 1178. | 612. | 453. | 379. |
| 20. | 1343. | 817. | 566. | 449. |
| 30. | 1477. | 984. | 682. | 542. |
| 40. | 1591. | 1126. | 799. | 647. |
| 50. | 1691. | 1251. | 914. | 758. |
| 60. | 1782. | 1363. | 1026. | 870. |
| 70. | 1864. | 1466. | 1135. | 981. |
| 80. | 1941. | 1561. | 1239. | 1090. |
| 90. | 2013. | 1651. | 1340. | 1195. |
| 100. | 2081. | 1736. | 1436. | 1296. |

EXAMPLE 3

When two inches of insulation is used at the conditions of Example 1 the following maximum temperatures can be calculated:

TABLE III

| Length of Heated Zone (ft.) | Casing Wall Temp. | Steam Temp. | Tubing Wall Temp. | Oxygen Temp. |
|---|---|---|---|---|
| 0.0 | 470. | 350. | 350. | 350. |
| 10. | 518. | 402. | 370. | 356. |
| 20. | 558. | 446. | 394. | 370. |
| 30. | 593. | 483. | 419. | 389. |

TABLE III-continued

| Length of Heated Zone (ft.) | Casing Wall Temp. | Steam Temp. | Tubing Wall Temp. | Oxygen Temp. |
|---|---|---|---|---|
| 40. | 624. | 516. | 445. | 412. |
| 50. | 652. | 547. | 471. | 436. |
| 60. | 679. | 576. | 498. | 462. |
| 70. | 704. | 603. | 524. | 488. |
| 80. | 729. | 629. | 551. | 514. |
| 90. | 752. | 655. | 576. | 540. |
| 100. | 775. | 679. | 602. | 566. |

EXAMPLE 4

When the conditions in Example 3 are varied by increasing the process temperature to 3500° F. the following maximum temperatures can be calculated:

TABLE IV

| Length of Heated Zone (ft.) | Casing Wall Temp. | Steam Temp. | Tubing Wall Temp. | Oxygen Temp. |
|---|---|---|---|---|
| 0.0 | 776. | 350. | 350. | 350. |
| 10. | 934. | 533. | 422. | 370. |
| 20. | 1062. | 681. | 502. | 419. |
| 30. | 1169. | 805. | 587. | 486. |
| 40. | 1262. | 913. | 673. | 562. |
| 50. | 1346. | 1009. | 760. | 644. |
| 60. | 1422. | 1098. | 845. | 727. |
| 70. | 1494. | 1181. | 929. | 811. |
| 80. | 1562. | 1259. | 1010. | 895. |
| 90. | 1626. | 1333. | 1090. | 976. |
| 100. | 1687. | 1404. | 1167. | 1056. |

EXAMPLE 5

When one inch of insulation is used at a steam injection rate of 3284 lbs./hr. of steam and an oxygen injection rate of 5832 lb./hr. of oxygen and a process temperature of 2000° F. are used the following maximum temperatures can be calculated:

TABLE V

| Length of Heated Zone (ft.) | Casing Wall Temp. | Steam Temp. | Tubing Wall Temp. | Oxygen Temp. |
|---|---|---|---|---|
| 0.0 | 391. | 350. | 350. | 350. |
| 10. | 404. | 363. | 355. | 351. |
| 20. | 415. | 374. | 360. | 353. |
| 30. | 425. | 384. | 366. | 357. |
| 40. | 434. | 394. | 372. | 362. |
| 50. | 442. | 402. | 378. | 367. |
| 60. | 450. | 411. | 385. | 373. |
| 70. | 458. | 419. | 391. | 379. |
| 80. | 466. | 426. | 398. | 385. |
| 90. | 473. | 434. | 405. | 391. |
| 100. | 480. | 441. | 412. | 398. |

EXAMPLE 6

When a 3500° F. process temperature is used in the calculations of Example 5 the following maximum temperatures can be calculated:

TABLE VI

| Length of Heated Zone (ft.) | Casing Wall Temp. | Steam Temp. | Tubing Wall Temp. | Oxygen Temp. |
|---|---|---|---|---|
| 0.0 | 504. | 350. | 350. | 350. |
| 10. | 549. | 397. | 367. | 354. |

TABLE VI-continued

| Length of Heated Zone (ft.) | Casing Wall Temp. | Steam Temp. | Tubing Wall Temp. | Oxygen Temp. |
|---|---|---|---|---|
| 20. | 588. | 439. | 387. | 363. |
| 30. | 624. | 476. | 408. | 376. |
| 40. | 656. | 510. | 430. | 393. |
| 50. | 686. | 542. | 453. | 412. |
| 60. | 714. | 571. | 477. | 433. |
| 70. | 741. | 599. | 501. | 455. |
| 80. | 767. | 626. | 525. | 477. |
| 90. | 791. | 652. | 549. | 501. |
| 100. | 816. | 678. | 573. | 524. |

EXAMPLE 7

When two inches of insulation is used at a process temperature of 2000° F. at the flow rates stated in Example 5 the following maximum temperatures can be calculated:

TABLE VII

| Length of Heated Zone (ft.) | Casing Wall Temp. | Steam Temp. | Tubing Wall Temp. | Oxygen Temp. |
|---|---|---|---|---|
| 0.0 | 377. | 350. | 350. | 350. |
| 10. | 385. | 358. | 353. | 351. |
| 20. | 392. | 366. | 356. | 352. |
| 30. | 399. | 372. | 360. | 355. |
| 40. | 405. | 378. | 364. | 358. |
| 50. | 410. | 384. | 368. | 361. |
| 60. | 416. | 390. | 373. | 365. |
| 70. | 421. | 395. | 377. | 369. |
| 80. | 426. | 400. | 381. | 373. |
| 90. | 431. | 405. | 386. | 377. |
| 100. | 435. | 409. | 390. | 381. |

EXAMPLE 8

When a 3500° F. process temperature is used under the conditions of Example 7 the following maximum temperatures can be calculated:

TABLE VIII

| Length of Heated Zone (ft.) | Casing Wall Temp. | Steam Temp. | Tubing Wall Temp. | Oxygen Temp. |
|---|---|---|---|---|
| 0.0 | 450. | 350. | 350. | 350. |
| 10. | 480. | 381. | 361. | 352. |
| 20. | 507. | 408. | 374. | 358. |
| 30. | 531. | 433. | 388. | 367. |
| 40. | 553. | 456. | 403. | 378. |
| 50. | 573. | 477. | 418. | 391. |
| 60. | 592. | 497. | 434. | 405. |

TABLE VIII-continued

| Length of Heated Zone (ft.) | Casing Wall Temp. | Steam Temp. | Tubing Wall Temp. | Oxygen Temp. |
|---|---|---|---|---|
| 70. | 611. | 516. | 450. | 419. |
| 80. | 628. | 534. | 466. | 434. |
| 90. | 646. | 552. | 482. | 450. |
| 100. | 662. | 569. | 498. | 466. |

Carbon and low alloy steel casings are typically used in such casing and tubing and will retain about 50% of their room temperature strength up to about 900° F. and about 20% of their room temperature strength up to about 1000° F. Thus, it is desirable to hold the metal temperature to below 900° F. in the casing. At the calculated process temperature of 2500° F. one inch of insulation would be adequate for heated lengths up to about 80 ft. at the low flow rate. Two inches would be adequate under all conditions and up to 100 ft. of heated length.

Having thus described the invention, I claim:

1. A method for injecting a gaseous stream into a subterranean zone in underground coal gasification processes wherein elevated temperatures occur in said subterranean zone; said method consisting essentially of:

a. positioning a casing means in fluid communication with said hot subterranean zone and the surface;

b. insulating a lower portion of the outer surface of said casing, said lower portion including the portion of said casing in the zone of elevated temperature in said subterranean zone by positioning an insulating material having a meeting point above 3500° F. about the outer surface of said casing prior to cementing said casing in position; and c. injecting said gaseous stream comprising a mixture of gases including at least one free oxygen containing gas into said subterranean zone through said casing at a rate sufficient to maintain said lower portion below a temperature of about 900° F. when elevated temperatures occur in said subterranean zone.

2. The method of claim 1 wherein said gaseous stream is injected through said casing at a flow rate in excess of 20 lb./sec./ft./$^2$.

3. The method of claim 1 wherein said mixture of gases is injected into said hot subterranean zone through a tubing means positioned through said casing.

4. The method of claim 3 wherein a second gaseous stream consisting essentially of steam or carbon dioxide is injected into said subterranean zone through said casing.

5. The method of claim 4 wherein said hot subterranean zone comprises a coal deposit.

6. The method of claim 1 wherein said insulating material is enclosed in a sheathing means.

* * * * *